United States Patent [19]

Bernold

[11] 3,938,786

[45] Feb. 17, 1976

[54] APPARATUS FOR WET SPRAYING OF CONCRETE

[76] Inventor: Jean Bernold, Im Hasenberg, 8880 Walenstadt, Switzerland

[22] Filed: May 2, 1974

[21] Appl. No.: 466,474

Related U.S. Application Data

[62] Division of Ser. No. 311,500, Dec. 4, 1972, abandoned.

[52] U.S. Cl. ..... 259/151

[51] Int. Cl.[2] ..... B28C 5/06

[58] Field of Search ..... 259/151, 147, 4, 18, 36, 259/178 R, 169, 170, 148; 222/193; 302/47

[56] References Cited

UNITED STATES PATENTS

| | | | |
|---|---|---|---|
| 1,372,385 | 3/1921 | Wilson | 259/151 |
| 1,670,677 | 4/1928 | Brown | 259/151 |
| 1,848,122 | 3/1932 | Forster | 259/151 |
| 2,075,867 | 4/1937 | Sampel | 259/151 |
| 2,238,051 | 4/1941 | Hackley | 259/151 |
| 2,307,509 | 1/1943 | Joachim | 259/4 |
| 2,577,664 | 12/1951 | Pro | 259/151 |
| 2,858,116 | 10/1958 | Hale | 259/151 X |

*Primary Examiner*—Robert W. Jenkins
*Attorney, Agent, or Firm*—Werner W. Kleeman

[57] ABSTRACT

An apparatus for the wet spraying of concrete, comprising a mixer embodying a mixing container incorporating means for closing such in a gastight fashion, a compressed air source connected with the mixing container, said mixing container incorporating a closable concrete outlet opening, a substantially cylindrical concrete containing conduit detachably introduced at one inner end through the concrete outlet opening and in a position substantially in alignment with the inner wall of the mixing container and a number of supplementary air infeed conduits located near the mixer and opening into the concrete containing conduit for the infeed therein of compressed air.

14 Claims, 6 Drawing Figures

APPARATUS FOR WET SPRAYING OF CONCRETE

CROSS REFERENCE TO RELATED CASE

This is a divisional application of my copending U.S. application Ser. No. 311,500, filed Dec. 4, 1972, now abandoned.

BACKGROUND OF THE INVENTION

The present invention relates to a new and improved apparatus for wet spraying concrete wherein the concrete is forced by means of compressed air out of a mixer into a concrete conduit and then sprayed out of such conduit.

During spraying of concrete with a standard granulation size up to 15 mm. and when working with one of its particular forms, so-called "gunite", problems particularly occur in the conduits during spraying. These problems do not appear to be capable of solution with conventional means. Thus, it was not heretofore possible, notwithstanding blowing-in of additional air, to convey the concrete in desired manner through the conduit for the spraying thereof, and even the heretofore proposed reduction in the cross-section of the conduit did not produce the desired result.

SUMMARY OF THE INVENTION

It is therefore a primary object of the present invention to provide an improved apparatus for the wet spraying of concrete in a manner which effectively and reliably fulfills the existing needs in the art and is not associated with the aforementioned drawbacks and limitations of the prior art proposals.

Now it has been surprisingly found that the existing drawbacks can be reliably overcome by the method aspects of this development which contemplates blowing supplementary air into the tubular conduit containing the moving concrete at the periphery of the conduit in the form of a number of air currents. These air currents may be infed in (a) radial direction, (b) in radial direction but offset from one another in the axial direction of the tubular conduit, (c) in a direction transverse to the lengthwise axis of the tubular conduit, or (d) in a direction transverse to the lengthwise axis of the tubular conduit and axially offset with respect thereto.

By means of this supplementary or additional air infeed it is possible to provide, on the one hand, a gliding or sliding layer with regard to the wall of the tubular conduit and, on the other hand, to increase the flow properties of the concrete, for instance the "gunite", when it is penetrated by the air and agitated thereby. Advantageously, by means of the supplementary air currents the concrete is placed into rotation about the lengthwise axis of the tubular conduit, thereby increasing the flow and sliding properties thereof.

Blowing-in of the supplementary air can take place into a tubular conduit or pipe which is advantageously cylindrical and extends past the location of infeed of the supplementary air. Thereafter, the remainder of the section of the tubular conduit can conically taper to the desired diameter, which remains constant up to the point of connection with the spray hose or conduit.

As previously indicated, not only is the invention concerned with the aforementioned method aspects but also relates to a new and improved construction of apparatus for the performance of the aforesaid method which comprises a mixer incorporating a mixing container which can be closed in a gastight fashion and possesses a stud-like concrete outlet opening which can be closed and which is connectable with a source of compressed air. In the stud-shaped concrete outlet opening there is detachably inserted a cylindrical or tubular concrete conduit which has its inner end in alignment with the inner wall of the mixing container. There are also provided a number of supplementary air infeed conduits located near the mixer, such air infeed conduits being connected to a source of compressed air and opening into such tubular concrete conduit. The supplementary air infeed conduits may be either approximately radially directed with the respective center of the outfeed mouths of the infeed conduits located in a common plane extending substantially perpendicular to the lengthwise axis of the tubular conduit, or such radial infeed conduits may be axially offset in the lengthwise direction of the tubular conduit. Further, the air infeed conduits may be axially inclined forwardly in the direction of feed of the concrete, with the center of each outfeed mouth located substantially in the same plane extending substantially perpendicular to the lengthwise axis of the tubular conduit, or such axially inclined air infeed conduits may be axially offset in the lengthwise direction of the tubular conduit wherein the center of each outfeed mouth thereof is then located in a different plane extending substantially perpendicular to the lengthwise axis of the tubular conduit.

These supplementary air infeed conduits are advantageously coupled to one another by an annular or ring-shaped distributor conduit, in which case then there is provided at the annular or ring-shaped conduit a connection location for the compressed air source.

After the aforementioned cylindrical or tubular concrete conduit there is advantageously connected the already mentioned conically tapering section of the concrete conduit.

Since the cross-section of the tubular conduit remains constant from the mixing container up to the location or locations of infeed of the supplementary or additional air, there is no damup or blocking of the material and there does not occur any change in its flow velocity. Only following the infeed locations for the supplementary air, with this embodiment, is the cross-section of the further section of the conduit reduced, increasing the flow velocity. Due to the liquefying action of the supplementary air which is blown-in according to the concepts of this development, it is possible to undertake a reduction in size of the cross-section of the conduit arrangement without having to fear that clogging will occur as was previously the case.

Good results have been obtained, for instance, if the aforementioned cylindrical or tubular conduit is provided with an inner width of, for instance, 70 mm. and then following the infeed locations for the supplementary air the conical conduit portion or section is reduced to about 50 mm. The spraying operation for the concrete can be carried out with good results with pressures in the order of 3 to 5 atmospheres absolute, wherein for a great number of situations it is possible to keep the pressure of the supplementary air lower.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
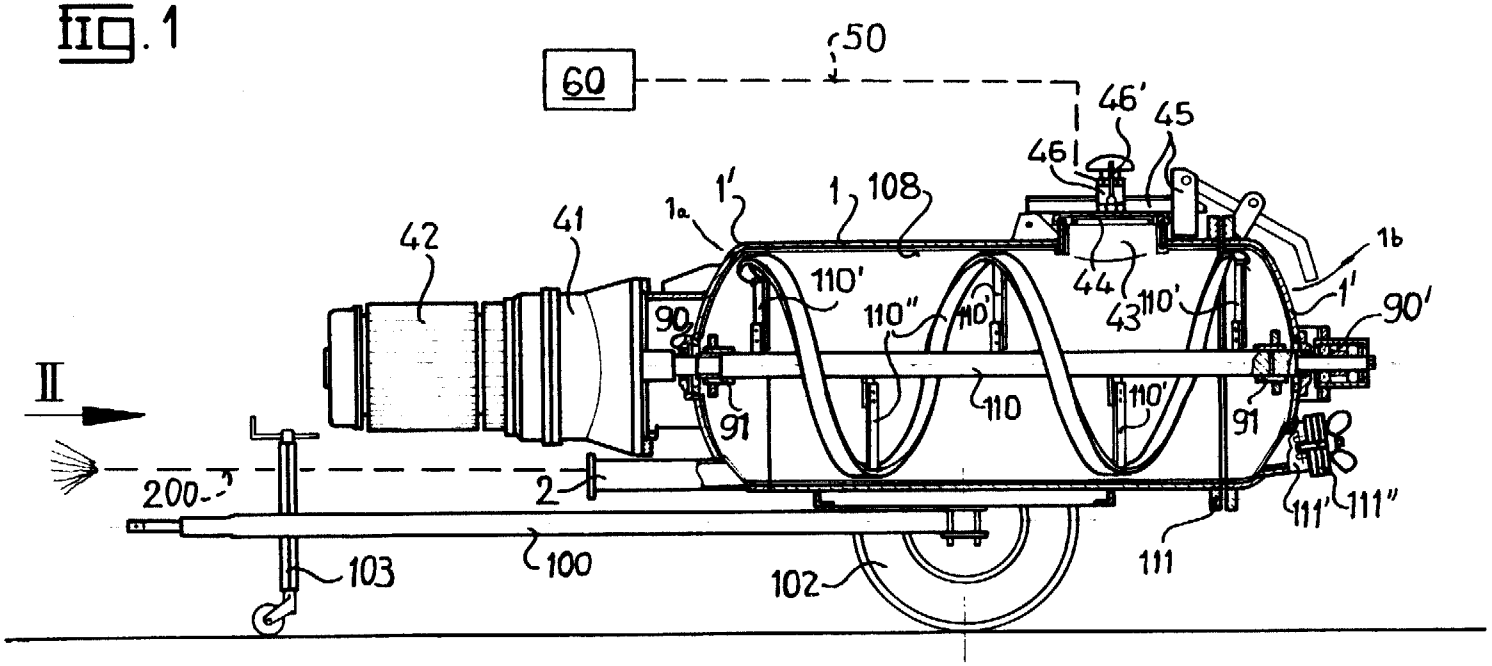
FIG. 1 is a longitudinal sectional view through a mixing and conveying apparatus mounted upon a single axle travelling carriage or undercarriage and designed according to the teachings of the present invention.
Figure 2:
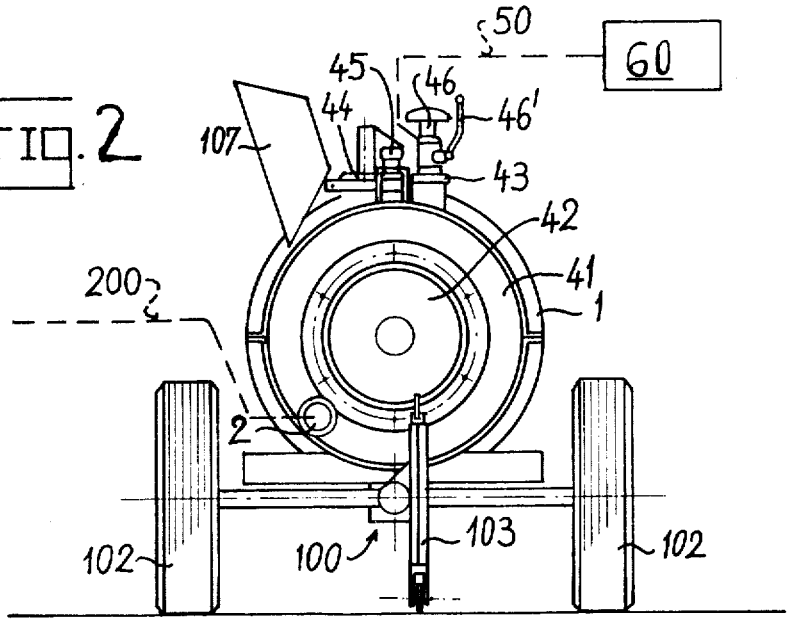
FIG. 2 is an end view, looking in the direction of the arrow II of FIG. 1, of the arrangement of FIG. 1.
Figure 4:
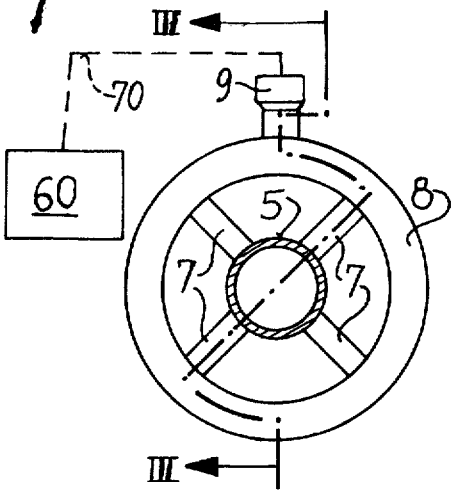
FIG. 4 is a cross-sectional view on a reduced scale with regard to FIG. 3, taken substantially along the line IV—IV of FIG. 3.

Describing now the drawings, in FIGS. 1 and 2 there is depicted a single axle travelling carriage or undercarriage 100 having wheels 102 and supports 103 upon which is mounted a mixer unit embodying a mixing container or drum 1. At the front end 1*a* of the mixing container 1 there is mounted an infinitely variable drive or transmission 41 and thereat a suitable drive motor 42, such that a mixer shaft 110, which will be considered in greater detail hereinafter, can be driven at a random rotational speed and in a random rotational sense or direction.

The mixing container 1 has an upper filling or infeed opening 43 with a suitable closure member or cover 44, which by means of any appropriate locking mechanism 45 permits the infeed opening 43 and therefore the mixing container 1 to be closed in gastight fashion. For the purpose of introducing pressurized gas, delivered by a compressor 60 through the agency of the schematically indicated conduit 50, there is provided an inlet 46 with a closure 46'. There is also contemplated the use of conventional overpressure protecting means for the system, such as valves or equivalent structure, which have not been particularly shown in the drawings since they may be of conventional design and are not really necessary for understanding the basic concepts of this development.

For the purpose of removing the handled material, typically concrete, from the mixing container 1 there is provided a connection or pipe stud 2 at the front closure cover 1' of the container 1, and this connection or stud 2 also can be closed by any suitable means such as a cover or the like.

A funnel 107, which has only been conveniently depicted in FIG. 2, can be suitably shifted over or in alignment with the infeed opening 43 if it is desired to fill the mixed material being handled, for instance the aggregate of cement, gravel and water, into the container 1.

The interior of the container 1 is lined with a wear resistant lining 108 which also extends to the region of the closure cover 1' of the container 1 and prevents wear of the container proper. This wear resistant lining

108 is exchangeable when there is removed the closure cover 1' at the rear end 1*b* of the container 1, for which purpose it is attached by suitable fastening means, for instance not particularly illustrated screws. When this rear closure cover 1' has been removed it is also possible to remove and exchange the mixer shaft 110 guided in bearings 90 and 90' through the agency of claw couplings 91. Then it is also possible to exchange the helically extending mixer worm or screw 110'' together with its supports 110' which are threadably connected to the shaft 110. It should be equally recognized that the screw or worm 110'' and the supports 110' intensively tumble and agitate the material within the container 1, thus conveying and therefore repeatedly mixing such material from one end of the container to the other. Consequently, the mixed material, namely in this case the concrete, arrives at the connection or pipe stud 2, from which location it is then expelled by the compressed air.

A cover 111'' at a cleaning stud or connection 111' can be conveniently removed if it is desired to clean the equipment after completion of the work or in the event it becomes clogged.

The closures 44 and 46', if desired, can be designed such that they can be conveniently remote-controlled in conventional fashion, for instance electropneumatically.

Figure 3:
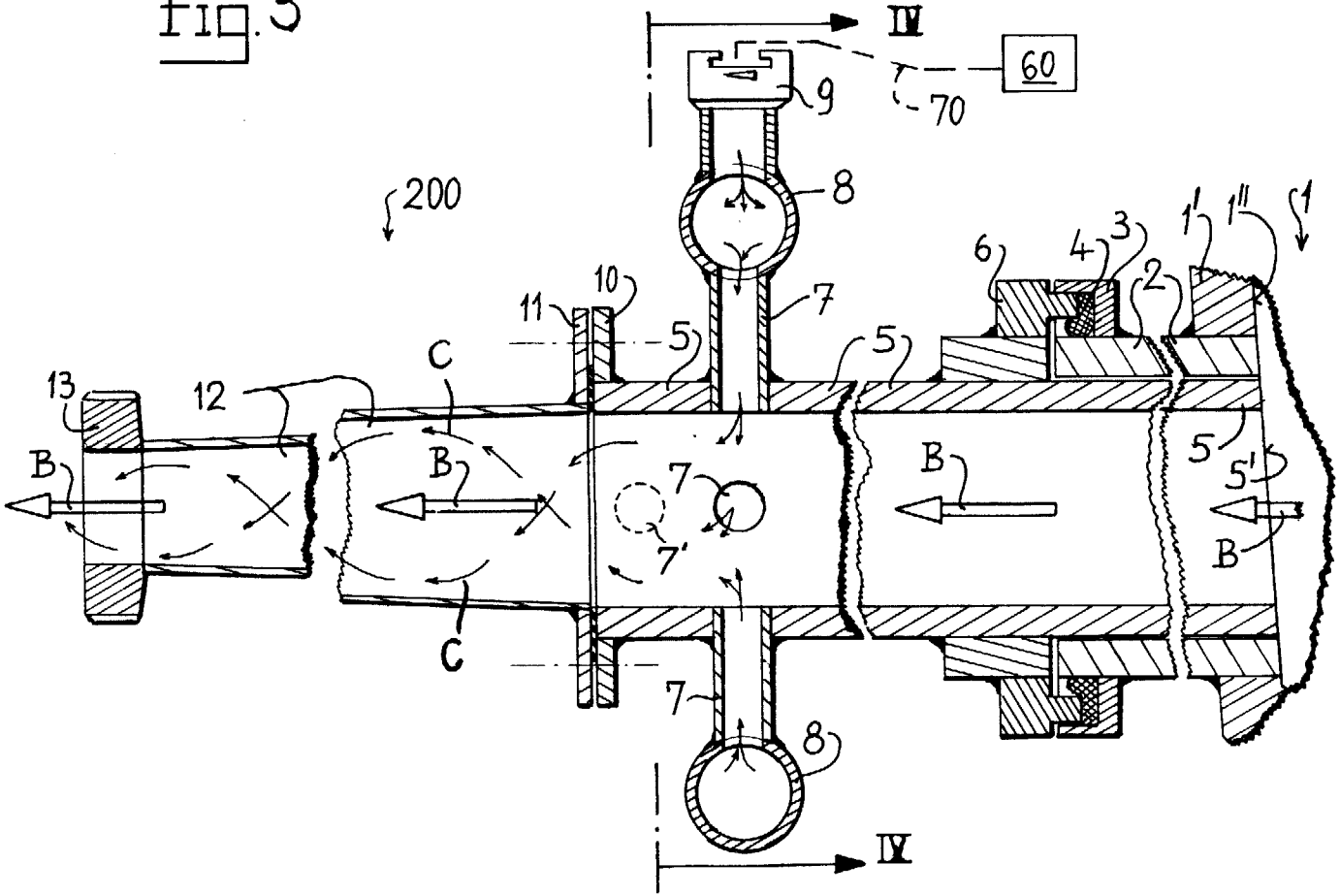
FIG. 3 is a longitudinal sectional view, on an enlarged scale in relation to FIGS. 1 and 2, of a portion of the concrete conduit or pipe and taken substantially along the line III—III of FIG. 4.

For the purpose of accommodating the diameter of the connection or stud 2 to the fineness or granulation size of the concrete it is possible to introduce a suitable tubular pipe or conduit 5 into the connection or pipe stud 2 such that the innermost end 5' of the pipe 5 and the inner surface 1'' of the container are flush with one another, thereby insuring for a good transition of such components, as best seen by referring to FIG. 3. The pipe 5 is welded to bayonet closure flange means 6 which engage with mating or counter flange means 3 at the connection or pipe stud 2 and at that location can be closed in a gastight fashion by means of the sealing arrrangement 4.

As best seen by referring to FIG. 3 supplementary air infeed conduits 7 open at their one respective outfeed mouth end into the pipe or conduit 5 and such infeed conduits 7 are here shown to be approximately radially directed. Further, as shown in phantom lines at 7' these radial conduits may be offset relative to one another in the direction of the lengthwise axis of the tubular conduit 5. The infeed conduits 7 are connected at their other end with an annular or ring-shaped distributor conduit 8. The annular conduit 8 is connected via connection or stud 9 and schematically indicated conduit 70 with a compressor, which conveniently is the aforementioned compressor 60 for the mixer container although a separate compressor could be also employed. The supplementary or additional air which is forced through the conduits 7 and enters the pipe 5 at the peripheral region thereof, passes intensively through the concrete, improves its flow properties and advantageously places such into rotation. The concrete then flows in the direction of the arrows B and this concrete is thus rotated about its feed direction in accordance with the spirals indicated by means of the arrows C.

Instead of the air infeed conduits being purely radially directed, it would be possible for same to be axially inclined in the direction of feed of the concrete through the tubular conduit. Modifications of the invention employing this concept have been shown in FIGS. 5 and 6.

Figure 5:
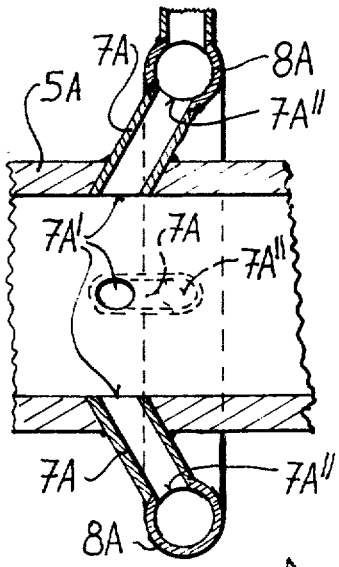
FIG. 5 is a fragmentary view depicting a further modification of the tubular concrete conduit with forwardly inclined air infeed conduits, the center of the respective outfeed mouths of which are located substantially in a common plane extending essentially perpendicular to the lengthwise axis of the tubular conduit.
Figure 6:
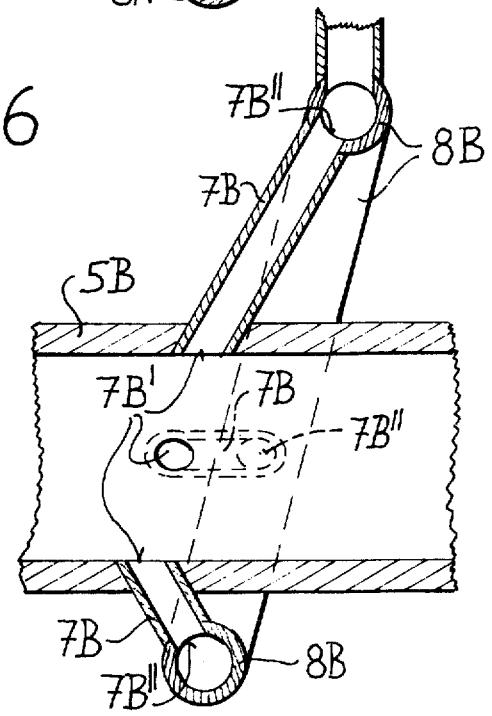
FIG. 6 is a modification of the arrangement of FIG. 5 with the air infeed conduits axially offset in the lengthwise direction of the tubular conduit.

Hence, in FIG. 5, it will be seen that the air infeed conduits 7A are axially inclined from the right towards the left of FIG. 5 in the direction of feed of the concrete through the tubular conduit 5A, each such air infeed conduit 7A having an air outfeed mouth 7A' communicating with the interior of the tubular conduit 5A and at the respective opposite end an air infeed mouth 7A'' connected with the ring-shaped or annular distributor conduit 8A. The center of each respective outfeed or outlet mouth 7A' of each air infeed conduit 7A is located in a plane which extends substantially perpendicular to the lengthwise axis of the tubular concrete conduit 5A.

In FIG. 6, there is again shown an arrangement of axially inclined air infeed conduits 7B, the air outfeed or outlet mouths 7B' of which communicate with the interior of the tubular concrete conduit 5B, and the air infeed mouths 7B'' of which are in flow communication with the annular or ring-shaped distributor conduit 8B. In this modification, however, it will be noted that the respective air infeed conduits 7B are axially offset with respect to one another in the lengthwise direction of the tubular concrete conduit 5B, and thus the center of each outfeed mouth 7B' is located in a respective plane extending substantially perpendicular to the lengthwise axis of the tubular concrete conduit 5B.

Of course, it would be conceivable for each of the embodiments disclosed herein to have only some of the air infeed conduits which communicate with the tubular concrete conduit axially offset with regard to one another and others located in a common radial plane or with the center of the respective outfeed mouth thereof located in a respective common radially extending plane. In all of the embodiments herein disclosed, it will be recognized that the air infeed conduits have their lengthwise axis extending transversely with respect to the lengthwise axis of the tubular concrete conduit.

Continuing, as shown in FIG. 3, a conically tapering reduction conduit or line 12 is mounted by means of non-illustrated screws or equivalent fastening devices via the flanges 10 and 11 at the concrete containing conduit or pipe 5, and by means of which it is possible to realize a reduction in the diameter of the conduit system down to the diameter of the non-illustrated spray hose or hoses. These spray hoses or spray conduits can be conveniently threaded to the flange 13.

Such equipment can be operated with an air supply of about 6 $m^3$/min. and a pressure of about 1 to 4 atmospheres absolute, there preferably being used a conduit diameter of 90 to 100 mm. (connection or stud 2) and after an internal reduction of the diameter of the pipe or conduit 5 to about 70 mm. Good conveying of the concrete can be realized with a pressure of 1 to 3 atmospheres absolute and a grain size of 0.01 to 30 mm., whereas for spraying there would be required a pressure of about 3 to 4 atmospheres absolute. It is possible to convey, for instance, 150 meters in the horizontal or 25 meters in the vertical, and the pressure can be maintained within conventional limits.

Finally, the feared fluttering and irregularity of operation or surging of the system is suppressed, and as a practical matter no clogging occurs.

While there is shown and described present preferred embodiments of the invention, it is to be distinctly understood that the invention is not limited thereto, but may be otherwise variously embodied and practiced within the scope of the following claims.

Accordingly, what is claimed is:

1. An apparatus for the wet spraying of concrete, comprising a mixer embodying a mixing container incorporating means for closing such in a gastight fashion, a compressed air source connected with the mixing container, said mixing container incorporating a closable concrete outlet opening defined by a connection pipe, a substantially cylindrical concrete containing conduit of substantially constant diameter detachably introduced at one inner end through the connection pipe and in a position substantially flush with the inner wall of the mixing container, and a number of supplementary air infeed conduits located near the mixer and opening into the concrete containing conduit at locations spaced circumferentially about the periphery thereof for the infeed therein of compressed air to suppress the formation of concrete slugs, the infed compressed air flowing towards the central lengthwise extending axis of the concrete containing conduit to break-up any possibly formed concrete slugs.

2. The apparatus as defined in claim 1, wherein said number of supplementary air infeed conduits extend substantially transversely with respect to the lengthwise axis of the concrete containing conduit.

3. The apparatus as defined in claim 1, wherein said number of supplementary air infeed conduits are arranged in a common plane extending substantially radially with respect to the lengthwise axis of the concrete containing conduit.

4. The apparatus as defined in claim 1, wherein said number of supplementary air infeed conduits are arranged axially offset in the lengthwise direction of the concrete containing conduit and extend substantially radially with respect to the lengthwise axis of the concrete containing conduit.

5. The apparatus as defined in claim 1, wherein said number of supplementary air infeed conduits are inclined with respect to the lengthwise axis of the concrete containing conduit.

6. The apparatus as defined in claim 5, wherein the inclined supplementary air infeed conduits are axially offset in the lengthwise direction of the concrete containing conduit.

7. The apparatus as defined in claim 1, wherein there is provided a compressed air source of the supply of compressed air to the supplementary air infeed conduits.

8. The apparatus as defined in claim 7, wherein a common compressed air source is employed for the infeed of the supplementary air and the air into the mixing container.

9. The apparatus as defined in claim 1, further including an annular distributor conduit means for interconnecting the supplementary air infeed conduits with one another, said annular distributor conduit means being connected with said compressed air source.

10. The apparatus as defined in claim 1, further including a conically tapering concrete conduit section connected with the substantially cylindrical concrete containing conduit.

11. The apparatus as defined in claim 1, wherein said closable concrete outlet opening possesses a diameter in the order of 90 to 100 mm.

12. The apparatus as defined in claim 11, wherein the inner diameter of said cylindrical concrete containing conduit is in the order of about 70 mm.

13. The apparatus as defined in claim 12, wherein the compressed air source provides a pressure in the order of 1 to 3 atmospheres for conveying the concrete through said cylindrical concrete containing conduit.

14. The apparatus as defined in claim 1, wherein the inner diameter of said cylindrical concrete conveying conduit is in the order of about 70 mm.

* * * * *